United States Patent [19]

Dugge et al.

[11] Patent Number: 4,598,646

[45] Date of Patent: Jul. 8, 1986

[54] HIGH VOLUME COVERED HOPPER CAR

[75] Inventors: Richard H. Dugge, St. Louis County; Donald E. Gruner, St. Charles County, both of Mo.

[73] Assignee: ACF Industries, Incorporated, Earth City, Mo.

[21] Appl. No.: 693,186

[22] Filed: Jan. 22, 1985

[51] Int. Cl.[4] ..... B61D 7/02; B61D 17/08

[52] U.S. Cl. ..... 105/248; 105/409; 220/5 A; 220/71; 296/203

[58] Field of Search ..... 105/247, 248, 249, 250, 105/253, 404, 409; 220/5 A, 71; 296/191, 203

[56] References Cited

U.S. PATENT DOCUMENTS

| | | | |
|---|---|---|---|
| 2,030,748 | 2/1936 | Gilpin | 105/409 |
| 3,339,499 | 9/1967 | Charles et al. | 105/248 |
| 3,490,387 | 1/1970 | Halcomb | 105/248 |
| 3,583,331 | 6/1971 | Mowatt-Larssen | 105/248 X |
| 4,168,665 | 9/1979 | Needham et al. | 105/248 |
| 4,498,400 | 2/1985 | Vorwerk et al. | 105/248 |

FOREIGN PATENT DOCUMENTS

| | | | |
|---|---|---|---|
| 2059339 | 6/1971 | Fed. Rep. of Germany | 105/248 |

*Primary Examiner*—Robert B. Reeves
*Assistant Examiner*—David F. Hubbuch
*Attorney, Agent, or Firm*—Polster, Polster and Lucchesi

[57] ABSTRACT

A high volume covered hopper railroad car is disclosed which maximizes the lading volume of a car while still utilizing smooth, sheet-like side sheets, and while remaining within AAR clearances. The high lading volume is achieved by forming the side sheets of the car from three radii of curvature, with the radius of curvature of the lower section of the side sheets being relatively short thereby to provide enhanced resistance to buckling, with the mid-portion of the side sheets of a relatively large radius of curvature thereby to provide a generally vertical region of the side sheets, and with the upper region of the side sheets being of a shorter radius of curvature thereby to again provide greater resistance to buckling at the top margin of the side sheets.

12 Claims, 4 Drawing Figures

HIGH VOLUME COVERED HOPPER CAR

BACKGROUND OF THE INVENTION

This invention relates to a high volume covered hopper car, such as typically used to transport granular or pulverant ladings, such as flour, cement, plastic pellets or powders, and the like.

Generally, covered hopper cars, such as are shown in the co-assigned U.S. Pat. No. 3,339,499 and 3,490,387, have come into widespread service. These covered hopper cars give many advantages to shipping granular or pulverant materials, facilitate loading and unloading of the lading, and maintain the lading in a clean, controlled environment during loading, transport, storage within the car, and during unloading. In the shipping of various granular or pulverant ladings, it is desirable that the car carry the maximum amount of the lading. Certain particulate ladings have bulk densities such that the lading carrying capability of a covered hopper car is limited by its lading volume capability rather than by the weight of the lading. Thus, there has been a long-standing need in the design of covered hopper cars to achieve as high a lading carrying volume as possible.

All railroad cars must fit within a three-dimensional clearance envelope, as defined by the Association of American Railroads (AAR). Generally, this AAR clearance envelope defines the maximum height, width, and length of a car such that the car will be able to negotiate railroad tracks across the country, and be able to pass through tunnels, over bridges, around curves, and past other trackside objects without interference. These clearance standards are specified in the AAR's "Specifications For Design, Fabrication, And Construction Of Freight Cars", which is in part set out in ACF Industries' Shippers' Car Line Division Service Bulletin 12*a*, entitled "Plate B and Plate C Clearance Diagrams", issued October, 1967, a copy of which is included in the file of the present specification, and is herein incorporated by reference.

Generally, two clearance diagrams or envelopes, known as AAR Plate B and Plate C are utilized. These clearance diagrams are actually composites of the clearance diagrams for all of the railroads in the country and may be considered to be a three-dimensional "tunnel" through which a car must be able to pass without touching the "tunnel". Not only must the car be able to pass through the "tunnel", but all car appurtenances, such as walkways, ladders, hatches, railings, etc., must also be kept within the limits of the diagrams. The AAR has defined a "base" car for both Plate B and Plate C clearances. In general terms, Plate B cars have a somewhat lower height (15 feet, 1 inch) than Plate C cars (15 feet, 6 inches), and may operate in unrestricted interchange service. Since Plate C cars are somewhat taller, these cars may operate in limited or restricted interchange service, and may be permitted only on certain routes. However, the restrictions placed on Plate C cars are relatively few in number, and for purposes of this disclosure, Plate C will be utilized as the standard clearance envelope for the railroad car of the present invention.

A freight car must not only be sufficiently narrow and less than a maximum predetermined height to pass through the AAR Plate C clearance diagram, but the maximum allowable width of the car is dependent on the distance between the centerlines of the trucks at the opposite ends of the car, and also on the amount of overhang or swing-out at the ends of the car. As will be appreciated, as a railroad car negotiates a curve, the center section of the car will move radially inwardly and the ends of the cars will move radially outwardly relative to a chord defined by the centerlines of the trucks of the car. The maximum curve considered by the AAR clearance diagrams is a 13 degree curve, having a radius of 441 feet, 8.375 inches. The AAR Plate C base car, having truck centers less than 46 feet, 3 inches, may have a maximum width of 10 feet, 8 inches. However, a car having truck centers spaced at the maximum permitted distance between truck centers of 81 feet may only be 8 feet, 2 inches wide. Cars of an intermediate length may have a maximum width between these two extremes, with the maximum width being dependent on the length of the car, as defined by the above-noted AAR specifications.

Thus, for one of ordinary skill in the art designing a covered hopper car maximizing the lading volume of the car, and optimizing the use of the materials utilized to construct the car, it is not practical to increase the lading volume of the car merely by increasing its length.

As is well known, the structure of center stub sill railroad cars requires that the upper chords of the car carry both certain bending loads applied to the car by the weight of the lading and the car, and certain train loads. These train loads typically take the form of forces required to resist moments induced in the end structure of the car due to the vertical offset between the centerline of the coupler and the respective cross section of the car. It has been found that center stub sill cars having smooth side sheets have a tendency to induce buckling in the areas of attachment of the side sheets to the side sills, and in the areas of attachment of the side sheets to the top chord or side plate reinforcement members. This tendency of the side sheets to buckle is sometimes referred to as diagonal buckling, which is caused by diagonal tension field effects, and which is most pronounced at the upper and lower ends of the side sheets. To further aid in understanding this buckling problem, the side sills, the top chord or side members, and the side sheets form a composite beam structure, with the side sheets constituting the web of the beam structure, and with the side sill and the top chord members constituting the upper and lower flanges or chords of the beam structure. However, since the thickness of the side sheet is relatively thin (typically the side sheets are approximately 3/16 inch [4.7 mm.] or less in thickness), and since the height of the side sheets is great (e.g., 10 or more feet [3 m.]), the side sheets are not inherently stable, and their resistance to buckling under loading is relatively low.

As noted above, the side sheets must have sufficient resistance to buckling and to other structural failure, with an adequate margin of safety under all anticipated normal operating conditions for the car. If straight, vertical side sheets are utilized, it has been found necessary to provide vertical stringers or hat sections at spaced intervals along the length of the side sheets to reinforce the side sheets against buckling. If these vertical hat sections are secured to the inside face of the side sheets, no appreciable lading volume is taken up within the car, but the lading will tend to accumulate in these hat sections and at the intersections of the various components of the car and the hat sections, thus making the lading difficult to clean from the car. A car which is difficult to clean may contaminate the next lading carried by the car. If the hat sections are placed on the outside of the car, the side sheets must be moved inwardly at least the depth of the hat sections, and thus the maximum lading volume of the car is appreciably decreased.

As described in the aforementioned co-assigned U.S. Pat. No. 3,490,387, the side sheets of prior art cars are generally of an arcuate shape struck from a generally constant radius, having a center at a substantial distance outside the confines of the car. More specifically, the radius of curvature of the arcuate side sheets of the prior art covered hopper cars disclosed in U.S. Pat. No. 3,490,387 was specified to have a radius of curvature between about 160–195 inches (see column 2, lines 30–35, of U.S. Pat. No. 3,490,387). Generally, these prior art covered hopper cars, in end elevation view, had a part cylindrical car body, with the radius of the sidewalls being substantially larger than the width of the car. It will thus be appreciated that if the cross section of the body of such prior art covered hopper cars were placed within the confines of the AAR Plate C height and width template, the bottom and tops of the side walls would be spaced a considerable distance from the confines of the AAR Plate C clearance diagram, as shown in FIG. 4. However, it has been found that if a substantially larger radius of curvature is utilized so as to increase the volume of the hopper car and yet still remain within the confines of the AAR Plate C diagram, the relatively thin side sheets will not have adequate resistance to diagonal buckling along their lower portions proximate the side sills, and along their upper portions proximate the cover sheets Thus, there has been a long-standing need for a covered hopper car having thin-walled side sheets without penalizing vertical reinforcements, and having adequate resistance to buckling.

SUMMARY OF THE INVENTION

Among the several objects and features of the present invention will be noted the provision of a covered hopper car of a center stub sill construction having smooth, thin side sheets maximizing the lading volume of the car and yet, remaining within AAR clearance tolerances;

The provision of such a covered hopper car which minimizes the tendency of the side sheets to buckle;

The provision of such a covered hopper car which does not require the use of penalizing vertical reinforcements to reduce the tendency of the smooth, thin side sheets to buckle;

The provision of such a car which efficiently uses material utilized to construct the car and optimizes the length, width, and height of the car with respect to its lading volume;

The provision of such a car which maximizes the lading volume therewithin, and yet provides sufficient height and width clearances for appurtenances, such as ladders, walkways, hatches, and the like; and The provision of such a car which is of relatively simple construction utilizing existing, standard tooling and production methods, which is of rugged and economical construction, and which has a long service life.

Other objects and features of this invention will be in part apparent and in part pointed out hereinafter.

Briefly, this invention relates to a center stub sill covered hopper car having a center stub sill assembly at each end of the car, and a side sill extending longitudinally of the car at each side thereof, at or above the elevation of the center stub sill. The car includes means for joining the side sills to the center stub sills. Side sheets are provided which are secured to the side sills, and a roof is secured to the upper margins of the side sheets. An end slope sheet is provided at each end of the car which is secured to the ends of the side sheets, and intermediate partition sheets are provided which extend transversely between and which are secured to the side sheets so as to define a plurality of hoppers within the car. More specifically, this invention relates to each of the side sheets having a first radius of curvature of a first region therein extending upwardly from its respective side sill, a second radius of curvature of a second region of the side sheet extending from the upper margin of the first region of the side sheet so as to constitute a major portion of the side wall of the car, and a third region of the side sheet extending upwardly from the upper margin of the second region to the roof of the car, with the radius of curvature of this third region being less than the radius of curvature of the second region. The first radius of curvature is relatively short so as to provide substantial resistance to buckling of the side sheet. The second radius of curvature is at least two times greater than the first radius of curvature, and the third radius of curvature is also relatively short in comparison to the second radius of curvature so as to provide substantial resistance to buckling of the side sheet.

BRIEF DESCRIPTION OF THE DRAWINGS

Corresponding reference characters indicate corresponding parts throughout the several views of the drawings.

DESCRIPTION OF A PREFERRED EMBODIMENT

Figure 4:
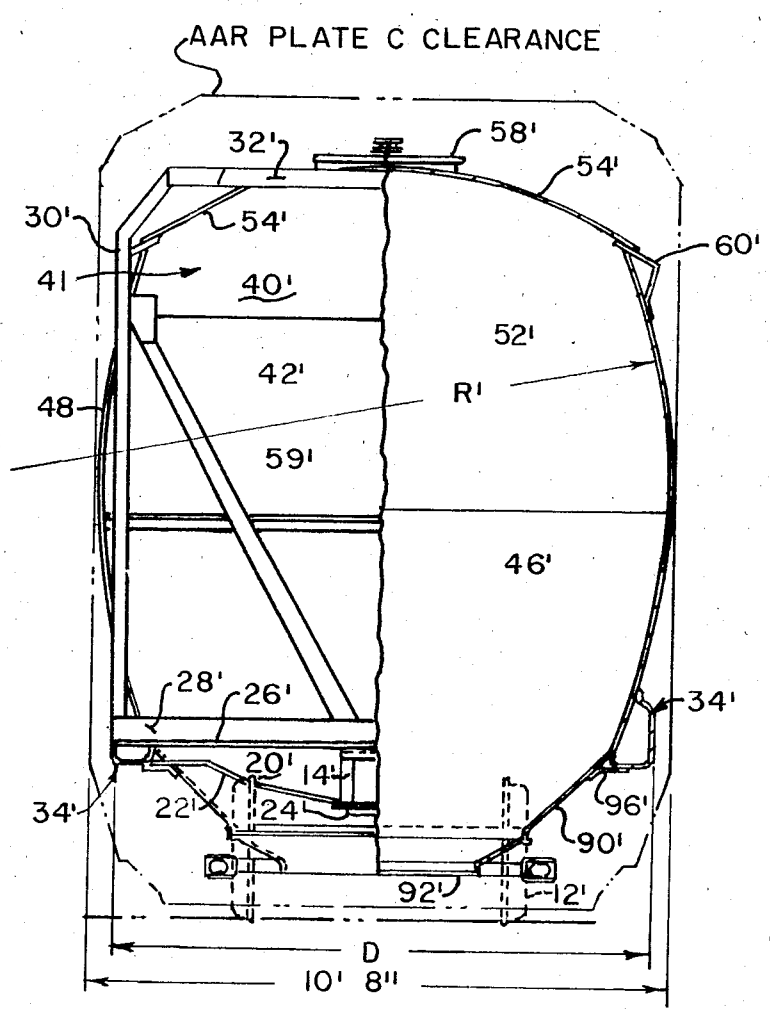
FIG. 4. PRIOR ART
FIG. 4 is a view similar to FIG. 1 of a prior art covered hopper car.

Referring now to the drawings, a covered hopper railroad car of the present invention is shown in its entirety by reference character 1. The car includes a covered hopper body 3 supported by conventional trucks 5 at either and of the car body, with the trucks riding on rails 7. The construction of trucks 5 is conventional, and the trucks, per se, do not constitute a part of this invention. Hence, for the sake of brevity, a detailed description of the construction of trucks 5 will not be herein provided.

Generally, car 1 is shown to be a stub center sill car, having a stub center sill assembly, as generally indicated at 9, carrying a conventional coupler 11. Car 1 has a pair of side sills 13*a*, 13*b* extending lengthwise of the car, one on each side thereof, generally at an elevation slightly above that of stub center sill assembly 9. As indicated at 15, structure is provided for joining the stub center sill assembly 9 to side sills 13*a*, 13*b* for transferring train loads longitudinally of the car from one coupler 11 to the other. Additionally, means 15 is utilized to support the weight of the car and its lading on trucks 5.

Car body 3 is constituted by a pair of side sheets 17*a*, 17*b* extending upwardly from a respective side sill 13a, 13b, and an arcuate roof 19 spans between and is secured (e.g., welded) to the upper end of the side sheets. The roof is provided with a plurality of hatches or the like (not shown) so as to permit loading of the car. The intersection joint between the arcuate roof 19 and the upper margins of side sheets 17*a*, 17*b* is indicated at reference character 20. A respective top chord side plate, as indicated at 21*a*, 21*b*, is secured to the upper margin of each of the side sheets 17*a*, 17*b* for stiffening and reinforcing the side sheets in the regions thereof proximate the side sheet-to-roof intersection 20. Further, car body 3 includes an end slope sheet 23 at each end of the car body, and one or more partition sheets 25 disposed in a generally vertical plane within the car body and being rigidly secured (welded) to the inside faces of the side sheets and to roof 19. As indicated at 27, slope partition sheets are also provided within the car sloping downwardly from the vertical partition sheets 25. Thus, a plurality (e.g., six) of hoppers H1, H2, H3 . . . are spaced lengthwise within car body 3. These hoppers include end hoppers (e.g., H1 and H6) and intermediate hoppers (e.g., H2–H5).

The structure 15 for joining stub center sill assembly 9 to side sills 13*a*, 13*b* is herein disclosed to include a generally horizontal shear plate 29 extending transversely of the car at each end thereof above stub center sill assembly 9, and being rigidly secured or welded to the inner faces of the outer ends of side sills 13*a*, 13*b*. A bolster weldment (not shown) is secured to the lower face of stub center sill assembly 9 and to shear plate 29 so as to support the end of the car on its respective truck 5 in the conventional manner. Additional details of construction of the bolster and the truck assembly may be had by referring to such prior co-assigned U.S Pat. Nos. as 3,339,499, 3,490,387, and 4,168,665.

Further, an end sill 31 is secured to the outer end of shear plate 29 and so as to extend transversely between side sills 13*a*, 13*b* at the outer end of the shear plate. An upper bolster web 33 extends upwardly from the inner end of the shear plate and is rigidly secured to extensions of side sheets 17*a*, 17*b* and to its respective end slope sheet 23 in a vertical plane generally coplanar with the centerline of truck assembly 5. As indicated generally at 35*a*, 35*b*, diagonal end slope stiffeners are provided between end slope sheet 23 and shear plate 29 for at least in part transferring the weight of the car to shear plate 29, and for reacting overturning moments between the upper portions of car body 3 and shear plate 29, as may be caused by train loads being transmitted from coupler 11 through stub center sill assembly 9 to side sills 13*a*, 13*b*, with the shear plate and the side sills being spaced above the centerline of coupler 11. It will be understood that other structural arrangements for structure 15, as heretofore described, may be utilized for joining the stub center sill assembly 9 to side sills 13*a*, 13*b* within the broader aspects of this invention.

Figure 1:
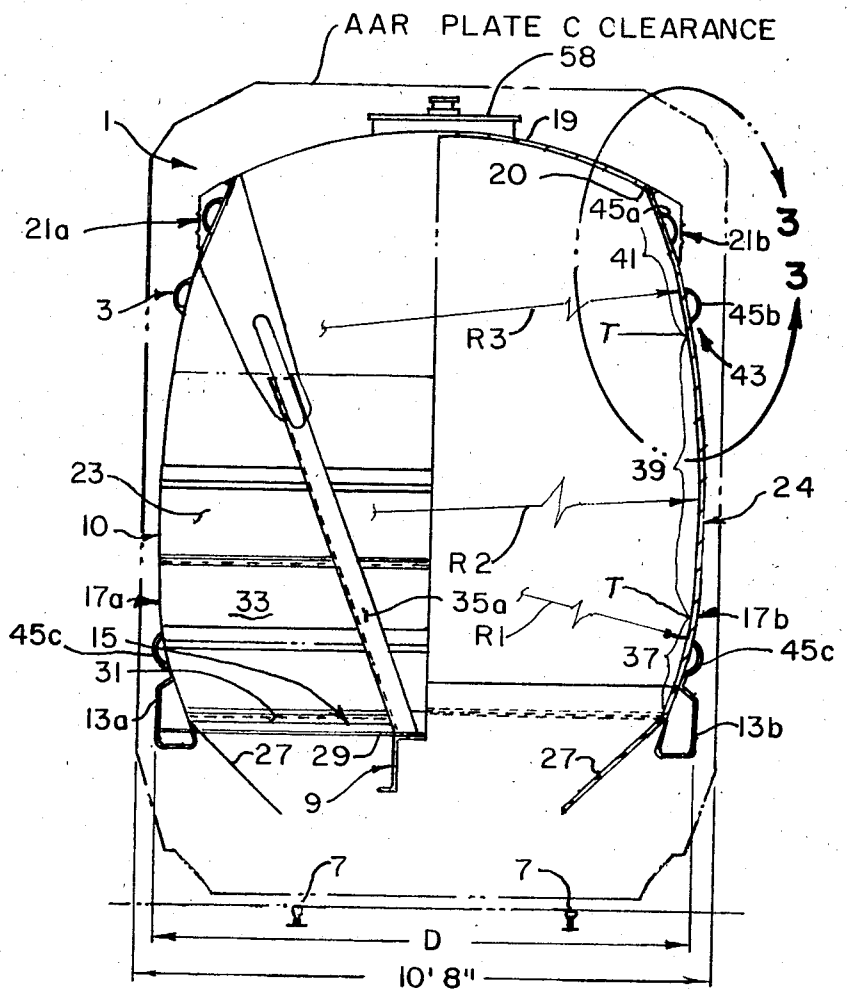
FIG. 1 is an end elevational view of a center stub sill covered hopper car of the present invention, with the right half of the car shown in cross section, and with the AAR Plate C clearance diagram shown in phantom surrounding the car.
Figure 2:
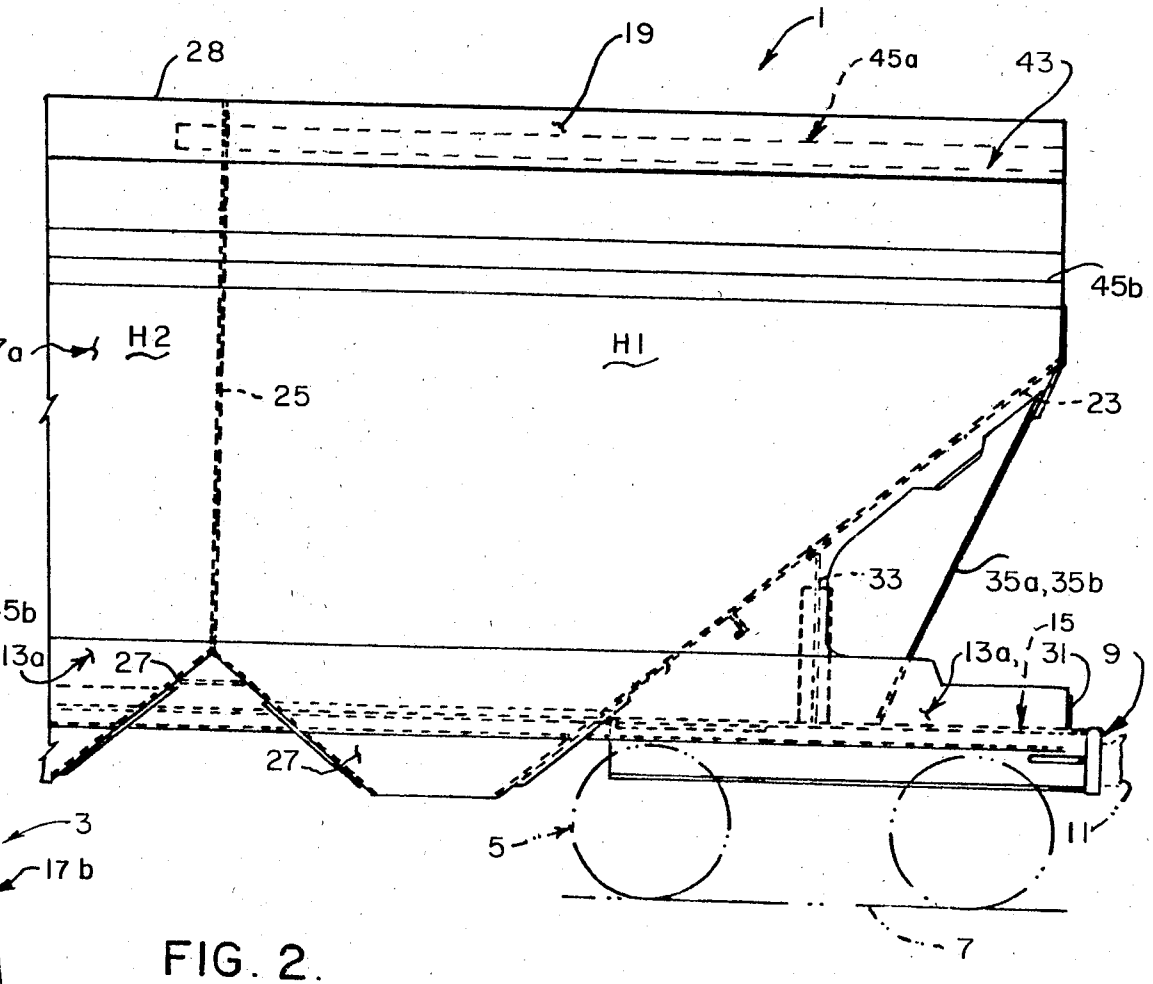
FIG. 2 is a side elevational view of the forward portion of the railroad car shown in FIG. 1.
Figure 3:
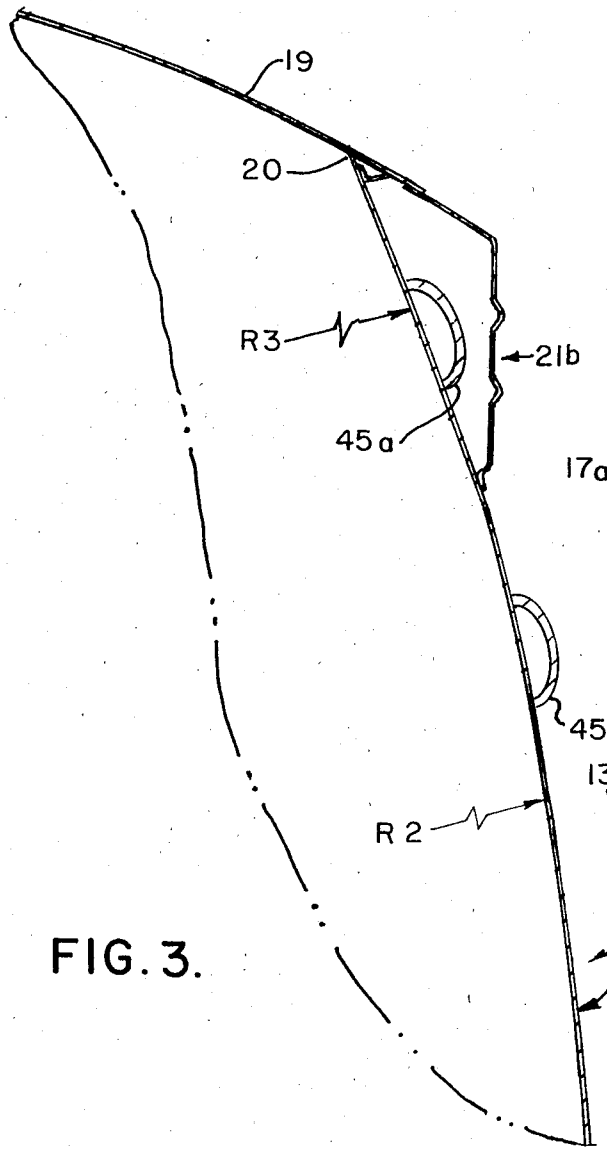
FIG. 3 is an enlarged view of a portion of the car of the present invention, taken along line 3—3 of FIG. 1.

Referring to FIG. 1, car 1 of the present invention is further provided with means, as generally indicated at 43, for reinforcing the upper margins or chords of side sheets 17*a*, 17*b*, so as to enhance the resistance to diagonal buckling of the side sheets along their upper margins. Of course, side plates 21*a*, 21*b* at the top chords of the side plate serve to reinforce the upper chords of car body 3. However, in addition to side plates 21*a*, 21*b*, car 1 of the present invention is provided with a pair of longitudinally extending channel-shaped side sections 45*a*, 45*b*, secured to the upper margins of side sheets 17*a*, 17*b* and extending longitudinally of the upper margins of the side sheets. These side sections 45*a*, 45*b* are open channel-shaped members, having their flanges securely attached (e.g., welded) to the side sheets. These side sections 45*a*, 45*b* are separate and apart from side plates 21*a*, 21*b*. As best shown in FIG. 3, side section 45*a* (which is shown in exaggerated thickness for purposes of clarity) is secured to the outer face of side sheet 13*b*, and is covered by side plate 21*b*. The lower side section 45*b* is secured to the outer face of side sheet 13*b* below cover plate 21*b*. Side sections 45*a*, 45*b* may extend the entire length of the car, or they may extend only along the regions of the car in which the side sheets have the greatest tendency to buckle. For example, side section 45*a* may extend along the end hoppers H1 and H6 and a portion of the next intermediate hopper, as shown in FIG. 2. As shown in FIG. 1, optional bottom side sections 45*c* may be secured to the lower region 37 of the side sheets proximate side sills 13*a*, 13*b* so as to reinforce these lower regions of the side sheets against the tendency for diagonal buckling.

In accordance with this invention, the volumetric capacity of car 1 of the present invention has been maximized, the use of materials to construct the car has been optimized, and yet car 1 still is within the limits of AAR clearances. As shown in FIG. 1 in phantom lines, the AAR Plate C clearance diagram is shown surrounding the end elevational view of car 1 of the present invention. While the Plate C diagram is shown in FIG. 1, it will be appreciated that by slight alterations to certain dimensions of the car, the car could, within the scope of the present invention, be designed to fit within AAR Plate B clearances. Generally, AAR Plate C clearances permit a car to have a maximum height including hatches 58 to be 15 feet, 6 inches (472.4 cm.). Additionally, the base Plate C car, as heretofore explained in the Background of the Invention, may have a maximum width of 10 feet, 8 inches (325.1 cm.). All structure of the car, except the wheels of truck 7, must be spaced 2.75 inches (7.0 cm.) above the top of rails 7.

Referring now to FIG. 4, a prior art covered hopper car is shown in cross section in a view substantially similar to car 1 of the present invention, as illustrated in FIG. 1. The reference characters in FIG. 4 are "primed", and correspond to the reference characters set forth in the above-noted co-assigned U.S. Pat. No. 3,339,499. As heretofore described in the Background of the Invention, such prior art covered hopper cars utilized an arcuate side sheet struck from a constant radius of curvature, as indicated by R′ in FIG. 4. Additionally, as shown in FIG. 4 the side sills 34′ of the prior art car are of a predetermined box beam construction, and the outside faces of the side sills are spaced apart from one another a fixed distance, as indicated at D in FIG. 4. More specifically, in a prior art covered hopper car as shown in FIG. 4, the constant radius of curvature of the side sheets, as indicated at R′, may range between about 160–195 inches. The particular prior art car shown in FIG. 4 has a radius of curvature of approximately 185 inches.

In accordance with the present invention, side sheets 17*a*, 17*b* of car 1 of the present invention are struck from three different radii of curvature, as indicated at R1, R2, and R3, for purposes as will appear. More specifically, a first or lower region of side sheets 17*a*, 17*b* is indicated at 37, and is shown to extend from the lower margin of the side sheet proximate side sills 13*a*, 13*b* upwardly above the side sills, with the radius of curvature R1 for the first side sheet region 37 being relatively short. For example, radius of curvature R1 may range between about 30 inches and 80 inches, with the radius of curvature shown in FIG. 1 being about 51.64 inches. Further, each side sheet is constituted by a second region, as indicated at 39, extending upwardly from the first region, and constituting the central, generally vertical part of the side wall of car body 3. In accordance with this invention, the radius of curvature of the second region of the side sheet 39 is struck from a radius of curvature R2 which is substantially greater than radius of curvature R1, and even more preferably, radius of curvature R2 is at least four times greater than the radius of curvature R1. Preferably, radius of curvature R2 ranges between about 185–400 inches. As shown in FIG. 1, radius of curvature R2 is about 256 inches. Still further in accordance with this invention, each of the side sheets 13*a*, 13*b* includes an upper or a third region of the side sheet, as indicated at 41, extending upwardly from the second region 39 to the upper margin of the side sheet and to the intersection 20 of the side sheet with roof 19. Radius of curvature R3 is substantially shorter than radius R2 and may be less than, equal to, or greater than radius R1. Preferably, radius R3 ranges between 30 and 150 inches In the configuration of car 1 shown in FIG. 1, radius R3 is shown to be about 120 inches. Smooth transitions, as indicated at T, are provided between regions 37 and 39, and between regions 39 and 41, so that each of the side sheets 17*a*, 17*b* have a generally smooth curvilinear cross section.

By providing side sheets 17*a*, 17*b* of the car of the present invention which are struck from the three different radii of curvature, as above described, the volumetric capacity of the car is maximized, and the resistance to buckling of the side sheets is also maximized. More specifically, by providing a relatively short radius of curvature R1 for the first or lower region 37 of the side sheets 17*a*, 17*b* in the area to which the side sheets are joined to side sills 13*a*, 13*b*, the relatively short radius of curvature R1 greatly enhances resistance to buckling of the side sheets in the regions adjacent the side sills which are prone to buckling. Thus, the lower regions of the side sheets are substantially strengthened so as to withstand diagonal buckling. Further in accordance with the invention, by providing the relatively long radius of curvature R2 for the intermediate region 39 of side sheets 17*a*, 17*b*, the intermediate regions of the side sheets are substantially vertical, thus serving to maximize the lading volume of the car. Further, radius R3 is of a shorter radius of curvature than radius R2, and thus this shorter radius of curvature tends to enhance the buckling resistance of the upper region 41 of the side sheets, particularly in the areas to which top chords 21*a*, 21*b* are secured to the outer surfaces of the side sheets. It will be appreciated that the tendency of side sheets 17*a*, 17*b* to buckle is most pronounced at the ends of the car body. In the design illustrated, radius R3 is shown to be greater than radius R1, thus significantly increasing the lading volume of the car. While the larger radius R3 may have less resistance to buckling, the upper regions of the side sheets are reinforced against buckling by top chords 21*a*, 21*b* and by side sections 45*a*, 45*b* thereby to withstand buckling loads while facilitating increased lading volume. However, within the broader aspects of this invention, radius R3 may be smaller than radius R1.

A car 1 of the present invention utilizing the preferred radii of curvature, R1, R2, R3, as above defined, and having a car length of 65 feet, 8 inches over the strikers, a length of 55 feet, 0 inch over the truck centers, a width over the side sheets of 121.94 inches, a width D over the side plates of 108.5 inches, and a height from the top of the rails to the top of roof 19 of 181 inches, has a lading volume of about 6,404 cubic feet. Such a car may have six hoppers H1–H6, with the end hoppers each having a lading volume of approximately 1,414 cubic feet, and with the intermediate hoppers each having a lading volume of approximately 894 cubic feet. It will be noted that the lading volume of the car has thus been maximized while retaining the use of sloped end sheets 23 which are necessary in the gravity unloading of many pulverant ladings.

By way of comparison, ACF Industries, Incorporated's CENTERFLOW® covered hopper car, Model 5701C, has a length over the strikers of 62 feet, and a lading volume of 5,700 cubic feet. Further, ACF Industries has heretofore designed and built a Model 5700 covered hopper car, having a length over the strikers the same as car 1 of the present invention (i e., 65 feet, 8 inches), but this prior Model 5700 car had a lading volume of only 5700 cubic feet. Because the additional 3 feet, 8 inch length of the Model 5700 covered hopper car over the Model 5701C hopper car yielded no appreciable increase in lading volume, it was not believed that the additional 3 feet, 8 inches of length with its corresponding increase in car weight, made efficient use of the materials from which the car was constructed. However, in contrast with the prior art Model 5700 covered hopper car, the hopper car 1 of the present invention has a lading volume of 6,404 cubic feet, or an additional 703 cubic feet increase in lading volume. This represents a 12.3 percent increase in lading volume over the prior art Model 5700 covered hopper car, while the weight of the prior Model 5700 covered hopper and car 1 of the present invention was essentially the same. Car 1 of the present invention also represents a 703 cubic foot or a 12.3 percent increase in lading volume over ACF's Model 5701C, while realizing essentially the same efficient utilization of materials. It should be noted, however, that both the Model 5700 and 5701C cars were four hopper cars whereas the car 1 of the present invention has six hoppers. While there is a more efficient use of potential lading volume realized by a six hopper car, the above-noted increases in lading volume nevertheless represent a significant step forward in the design of covered hopper cars efficiently utilizing the materials from which they are constructed, thus permitting shippers to ship greater quantities of commodities on each trip at lower cost.

As heretofore mentioned, car 1 of the present invention has a width D over the side sills 13*a*, 13*b* of about 121 inches, which is the same width as prior art covered hopper cars, such as shown in FIG. 4. By utilizing the same width over the side sills in covered hopper car 1 of the present invention as is in the case of the prior art cars, significant amounts of tooling and fixtures, as well as a number of common parts, such as side sills 13*a*, 13*b*, center plate 29, end diagonals 35*a*, 35*b*, and other components from prior art cars may be utilized to construct the car 1 of the present invention. This feature can significantly lower production costs of the high volume covered hopper car 1 of the present invention.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

What is claimed is:

1. In a center stub sill covered hopper car having a center stub sill assembly at each end of the car, a side sill extending longitudinally of the car at or above the approximate elevation of said center stub sill assembly, means joining said side sills to said center stub sill assembly, a side sheet secured to each of said side sills and extending upwardly thereabove so as to constitute a side of said car, a roof secured to the upper ends of said side sheets, an end sheet at each end of said car secured to the ends of said side sheets so as to define the ends of said car, and at least one intermediate partition sheet extending between and secured to said side sheets thereby to divide said car into a plurality of hoppers, wherein the improvement comprises: each of said side sheets having a first radius of curvature in a first region thereof extending upwardly from its respective said side sill, a second radius of curvature of a second region of said side sheet extending from said first region so as to constitute a major portion of the side walls of said car, and a third radius of curvature of a third region of said side sheet extending generally upwardly from the upper margins of said second region to said roof, said first radius of curvature being relatively short so as to provide substantial resistance to buckling of said side sheet in said first region, said second radius of curvature being at least two times greater than said first radius of curvature such that said second region of said side sheet is substantially vertical thereby to facilitate maximizing the lading volume of said car, and said third radius of curvature being also relatively short in comparison to said second radius of curvature so as to provide substantial resistance to buckling of said side sheets in said third region.

2. In a covered hopper car as set forth in claim 1 wherein said first radius of curvature ranges between about 30 and 80 inches.

3. In a covered hopper car as set forth in claim 1 wherein said second radius of curvature ranges between about 185 and 400 inches.

4. In a covered hopper car as set forth in claim 1 wherein said third radius of curvature ranges between about 30 and 150 inches.

5. In a covered hopper car as set forth in claim 1 wherein said car further includes reinforcing means extending longitudinally of each of said side sheets at the upper portions thereof, said reinforcing means including a top chord reinforcing plate and at least one channel-shaped reinforcing member independent of said top chord reinforcing plate, this last-said reinforcing member extending at least part-way from one end of the car toward the other end thereof.

6. In a covered hopper car as set forth in claim 5 wherein said reinforcing member extends from one end of the car to the other.

7. In a covered hopper car as set forth in claim 5 wherein said reinforcing means includes two of said channel-shaped reinforcing members spaced vertically apart from one another.

8. In a covered hopper car as set forth in claim 7 wherein one of said channel-shaped reinforcing members is disposed within said top chord reinforcing plate.

9. In a covered hopper car as set forth in claim 1 wherein said car includes means in addition to said side sills for reinforcing the lower portion of said side sheets proximate said side sills against buckling, said reinforcing means comprising at least one channel-shaped reinforcing member independent of said side sill, this last said reinforcing member extending at least part way from one end of the car toward the other end thereof.

10. In a covered hopper car as set forth in claim 2 wherein said first radius of curvature is about 52 inches.

11. In a covered hopper car as set forth in claim 3 wherein said second radius of curvature is about 256 inches.

12. In a covered hopper car as set forth in claim 4 wherein said third radius of curvature is about 120 inches.

* * * * *